US005560275A

United States Patent [19]

Bauspiess et al.

[11] Patent Number: 5,560,275

[45] Date of Patent: Oct. 1, 1996

[54] DRIVE OF THE FLUID OR ELECTRIC TYPE WITH A CONTROL

[75] Inventors: Wolfgang Bauspiess, VS - Villingen; Jörg Niederstadt, Schramberg; Horst Röthele, Donaueschingen, all of Germany

[73] Assignee: Mannesmann Aktiengesellschaft, Dusseldorf, Germany

[21] Appl. No.: 407,927

[22] Filed: Mar. 21, 1995

[30] Foreign Application Priority Data

Mar. 21, 1994 [DE] Germany ..... 44 10 103.1

[51] Int. Cl.[6] ..... F15B 13/16; F01B 29/00

[52] U.S. Cl. ..... 91/361; 91/459; 92/88; 92/137

[58] Field of Search ..... 91/361, 363 R, 91/363 A, 459, 393; 92/88, 137, 85 A

[56] References Cited

U.S. PATENT DOCUMENTS

| | | | |
|---|---|---|---|
| 2,944,524 | 7/1960 | Brandstadter et al. | 91/361 X |
| 3,664,234 | 5/1972 | Simons et al. | 91/363 R |
| 4,450,753 | 5/1984 | Basrai et al. | 91/363 R X |
| 4,628,499 | 12/1986 | Hammett | 91/361 X |
| 4,896,582 | 1/1990 | Tordenmalm et al. | 1/393 X |
| 4,901,625 | 2/1990 | Bussan et al. | 91/361 |
| 4,915,281 | 4/1990 | Berger et al. | 91/361 X |
| 5,230,272 | 2/1993 | Schmitz | 91/361 |
| 5,347,914 | 9/1994 | Kinoshita et al. | 92/88 |

FOREIGN PATENT DOCUMENTS

| | | | |
|---|---|---|---|
| 4205506 | 5/1993 | Germany . | |
| 4201464 | 7/1993 | Germany . | |
| 1390445 | 4/1988 | U.S.S.R. | 91/361 |
| 1439504 | 6/1976 | United Kingdom | 92/85 A |

*Primary Examiner*—Edward K. Look
*Assistant Examiner*—Hoang Nguyen
*Attorney, Agent, or Firm*—Cohen, Pontani, Lieberman, Pavane

[57] ABSTRACT

The present invention relates to a drive of the fluid or electric type having a device for controlling an element for transmitting a driving force to a reciprocating or otherwise moveable or displaceable element and an arrangement for damping the driving force at at least one end of the element's travel. The driving force element is at least single-acting, and the drive may also include mechanical shock absorbers and sensors arranged in the area of the ends of travel. In order to achieve an especially soft striking or contact at the end of travel position of the driving force element, the control device includes a counter-pulse module which, via a pre-positioning sensor associated with at least one movement direction, causes a chronologically settable changeover from a previously flowed-through or activated first switching element associated with a first end of travel position to a previously unactivated second switching element associated with a second end of travel position.

12 Claims, 3 Drawing Sheets

SPS

GPM
GND
0V
+24V
+24 V

| | $V_A$ | $V_B$ |
|---|---|---|
| $K_A \ldots V_{PA}$ | x | |
| $V_{PA} \ldots T_{VA}$ | x | |
| $T_{VA} \ldots T_{GA}$ | | x |
| $T_{GA} \ldots T_{NA}$ | x | x |
| $> T_{NA}$ | x | |

DRIVE OF THE FLUID OR ELECTRIC TYPE WITH A CONTROL

BACKGROUND OF THE INVENTION

1. Field of the Invention

The present invention relates to a fluid or electric drive having a device for controlling the element which is transmitting a driving force to a reciprocating or otherwise moveable or displaceable element and an arrangement for damping the driving force at or proximate at least one end of the element's travel. The driving force element is at least single-acting and the drive may include mechanical shock absorbers and sensors arranged in the area of the end points of the element's travel.

2. Description of the Prior Art

A device for damping a piston, which is reciprocatably movable in a cylinder, at at least one of its end-of-travel areas is known from German Patent No. DE-42 01 464 A1. This prior art patent discloses a device which has a sensor, connected to an electronic control device, for sensing at least one position of the piston at at least one of its end-of-travel areas.

That art more particularly discloses a device which can be controlled by the electronic control device to reduce the outlet section of the outlet-side cylinder chamber when the end-of-travel area is reached. Accordingly, an attempt is made to brake the element transmitting the driving force on an air cushion using increased pressure in the end-of-travel area. However, this procedure is deficient in that it entails an increasing load on both the entire drive and its individual parts during the operating period.

SUMMARY OF THE INVENTION

The present invention is intended to provide a controlled braking and an especially soft striking or contact by the driving force element at the end of travel area of the element, even when the driving force element involves larger masses.

According to the invention, this object is attained through the provision of a counter-pulse module included in the controller. The counter-pulse module uses a pre-positioning sensor associated with at least one direction of an element's travel and brings about a chronologically settable changeover in the direction of travel of the element, directing the element from a first flowed-through switching element associated with a first end of the element's travel to a previously not flowed-through second switching element associated with a second or opposite end of the element's travel and then back to the first switching element. This makes it possible for the driving force element to be driven toward it's end of travel positions in a braked fashion. The direction of travel in this braked fashion is based upon control of the switching elements by a logic circuit. Control of the braking of the element in this manner allows control of elements having very large mass. In addition, the settable changeover of the switching elements and the dividing-up of the braking phase between the switching elements make the setting of times less critical because it is easier to set a low speed at the end of the braking phase. Thus, additional mechanical shock absorbers can be designed with low power reserve. The ability to use mechanical shock absorbers having a low power reserve decreases both the structural size and cost of the device.

According to further features of the invention it is possible, in a time segment following the changeover and flow through of the first switching element and the changeover of the second switching element, for both switching elements to be flowed through simultaneously. This is referred to as overtravel. After overtravel occurs, the originally active valve is then again flowed through in order to ensure reliable application of the driving force element to its end of travel area.

According to a further feature of the present invention, the changeover of the first or second switching element can be delayed using a first correcting element. In principle, this removes the need for an exact mechanical adjustment of the pre-positioning sensor as a delay in the initiation of the braking phase can compensate for inexact adjustment of the pre-positioning sensor.

In yet a further feature of the invention, the first switching element or the second switching element is connected to a second correcting element for setting the duration of the counter-pulse. The provision of the second correcting element makes it possible for the driving force element to approach a stop in a non-powered fashion at low speed, thus making the system less sensitive to fluctuations in operating conditions such as pressure or load.

A still further feature of the present invention is a third correcting element connected to either the first switching element or the second switching element for setting the overtravel time. The inclusion of a third correcting element similarly makes the system less sensitive to fluctuations in operating conditions such as changes in pressure or load.

Another feature of the present invention lies in the provision of a circuit logic for recognizing the "first" start of the drive and for adjusting the times set by the first through third correcting elements to starting conditions which differ from those of stationary operation.

A still further feature of the present invention is in the inclusion of separately settable correcting elements, for each direction of travel, included with the controller.

Yet another feature of the present invention is provided by two control tabs having a total of two sensors for the recognition of two pre-positions and two ends-of-travel, through coded evaluation.

In the case of a fluid drive, it is advantageous for each of the first and second switching elements to be implemented by a control valve, each of the control valves being under the control of the counter-pulse module and the memory-programmable controller.

In addition, it is advantageous that the end-of-travel sensors, the pre-positioning sensors and the first and second switching elements use optocouplers as a means for establishing connections.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, in which like reference numerals depict similar elements throughout the several views.

DETAILED DESCRIPTION OF THE PREFERRED EMBODIMENT

Figures 1A, 1B:
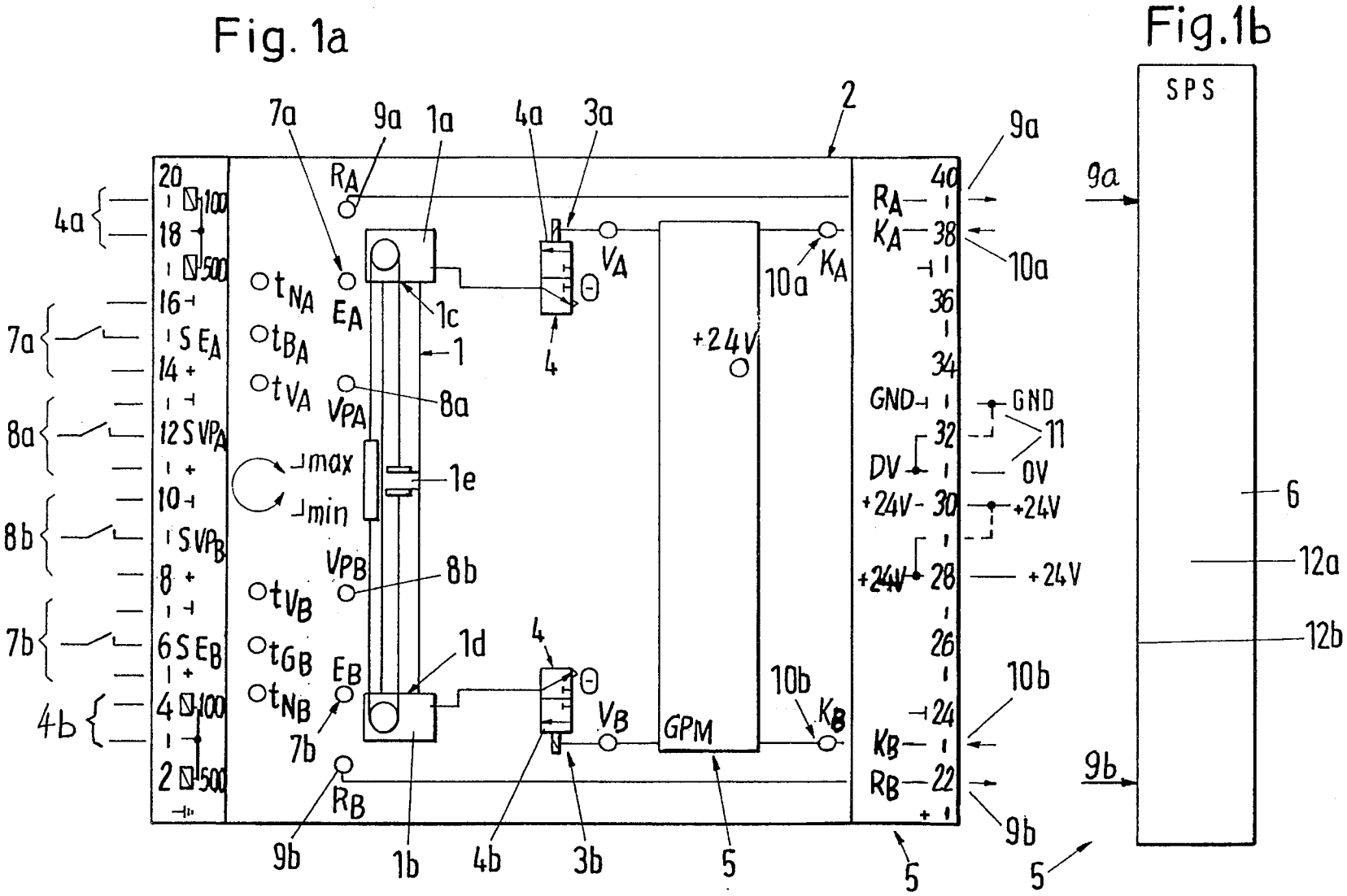
FIG. 1*a* is a front view of the counter-pulse module card including the respective wiring connections.
FIG. 1*b* is a block diagram of the associated memory programmed controller.

A fluid type drive constructed in accordance with the present invention is illustrated in FIG. 1. This figure shows a moveable piston cylinder arrangement 1, without piston rods, disposed on a counter-pulse module card 2.

A controller for the drive includes switching elements 3*a* and 3*b* associated with the end-of-travel areas 1*a* and 1*b*, respectively, of the piston cylinder arrangement 1. The switching elements 3*a* and 3*b* are each implemented by a high-speed valve, such as a control valve 4. The controller also includes a counter-pulse module 5 and a memory-programmed controller 6. The driving force element consists of a piston 1*e* which is reciprocatably movable between the end-of-travel areas 1*a*, 1*b*. On the left side (in FIG. 1*a*) of the counter-pulse module card 2 are provided various connections for receiving and inputting signals which initiate and sense the braking operation. These connections are for the first valve 4*a*, an end-of-travel sensor for the first valve 7*a*, a pre-positioning sensor for the first valve 8*a*, a pre-positioning sensor for the second valve 8*b*, an end-of-travel sensor for the second valve 7*b*, and a connection for the second valve 4*b*.

On the right side (in FIG. 1*a*) of the counter-pulse module card 2 are connections for controlling the switching elements and thus the braking of the moving element 1*e* during the braking phase. These connections, which will be further described hereinafter, include an information signal connection for the first switching element 9*a*, a command connection for the first switching element 10*a*, a connection for the mass 11, as well as a command connection for the second switching element 10*b* and an information signal connection for the second switching element 9*b*. There are also current connections 12*a* and 12*b* on the right side which connect to the memory-programmed controller 6. The information signal connections 9*a*, 9*b* lead to the memory programmed controller shown in FIG. 1*b*; the controller 6 may be carried on the card 2 or otherwise combined or associated with the card 2.

The braking phase consists of three time intervals:

a) Delay (T1): The signal from the pre-positioning sensor is delayed, in order to permit the application point of the braking sequence to be electrically adjusted;

b) Changeover (T2): The active or flowed-through switching element is switched off and the inactive or non-flowed through switching element is switched on; and c) Overtravel (T3): Both switching elements are activated.

After this, the originally active switching element is again activated, in order to ensure reliable application of the cylinder 1, without piston rods, to the end-of-travel positions 1*c*, 1*d*.

Because of the settable delay and the dividing-up of the braking phase, the setting of times becomes less critical since it is easier to set a low speed at the end of the braking phase. This permits the shock absorbers at the end-of-travel positions 1*c*, 1*d* for contact with the movable element 1*e* to be designed with less power reserve, which translates to savings in structural size and cost.

The braking phase is initiated by one of the pre-positioning sensors 8*a* or 8*b*. A signal is received through the command connection 10*b* (in FIG. 1*a*) indicating initiation of the braking phase. Upon receipt of this signal by the controller, the piston cylinder is caused to move in the direction of the pre-positioning sensor 8*a*, 8*b*, whereby a dampening is sensed by the pre-positioning sensor. As soon as the pre-positioning sensor 8*b* is dampened, a first correcting element 13*a*, 13*b* of the counter-pulse module (FIG. 2*a*) is operated to suitably delay the changeover of the respective valves 4*a*, 4*b*. It can be seen from FIG. 1 that the command signal connections 10*a*, 10*b* enter the counter-pulse module card 2 and are connected to valves 4*a* and 4*b*, respectively, through the counter-pulse module 5. Thus, upon receipt of the control signal from connection 10*a* or 10*b*, the first correcting element 13*a*, 13*b* delays the signal controlling the changeover of the respective valve 4*a*, 4*b*. A second correcting element 14*a*, 14*b* serves to set the duration of the counter-pulse and thus controls when the changeover from the first activated or flowed-through valve to the second valve, which has not previously been activated, will occur. A third correcting element 15*a*, 15*b* is used to set the overtravel time of the valves 4*a*, 4*b*. The third correcting element thus controls when the first activated valve will once again be switched on and activation will be allowed to occur for both valves; this is known as overtravel. After this overtravel occurs, the first valve is again activated. The piston cylinder is caused to move towards the end-of-travel sensor causing the end-of-travel sensor to sense a dampening. As soon as the time T for the first to third correcting elements 13*a*, 14*a*, 15*a*; 13*b*, 14*b*, 15*b* has expired and the end-of-travel sensor 7*a*, 7*b* is dampened, an information signal indicating certain parameters of the controller is sent through connections 9*a*, 9*b* to the memory-programmable controller 6. After receipt of the information signal by the memory programmed controller 6 and receipt by the counter pulse module 5 of a further command received through the command connections 10*a* and 10*b*, a return of the pre-positioning sensors 8*a*, 8*b*, the end-of-travel sensors 7*a*, 7*b* and the correcting elements 13*a*, 14*a*, 15*a*; 13*b*, 14*b*, 15*b* to their original states is initiated.

The counter-pulse module, furthermore, has separately settable correcting elements 13*a*, 13*b*, 14*a*, 14*b* and 15*a*, 15*b* for each direction of travel.

The described control includes the counter-pulse module 5 on the counter-pulse card 2 which is associated with at least one direction of travel. The direction of travel is based upon the damping of one of the pre-positioning sensors. Upon receipt of a signal indicating the damping of one of the pre-positioning sensors 8*a*, 8*b*, a chronologically settable changeover from an activated first switching element 3*a* associated with a first end-of-travel position 1*c* to a second switching element 3*b*, previously not activated and associated with a second end-of-travel position 1*d*, and then back to the first switching element 3*a*, is initiated. This is performed through the decoder 18 diagrammatically depicted in FIG. 2*a*. The decoder is coupled to the first, second and third correcting elements 13*a*, 14*a*, 15*a*; 13*b*, 14*b*, 15*b* for each end-of-travel position and transmits the correcting signal to the respective switching elements 3*a*, 3*b*.

The chronologically settable changeover of the switching elements can occur over any time period which is consistent with or appropriate for the goal of a damping effect.

After the changeover of the first switching element 3*a* and the second switching element 3*b* occurs, it is possible for both switching elements 3*a*, 3*b* to be activated simultaneously in a time segment, T3, in the sense of an overtravel.

As previously mentioned, the changeover of the first or second switching element 3*a*, 3*b* can be delayed by means of the first correcting element 13*a*, 13*b*. The first switching element 3*a* or the second switching element 3*b* is also connected to the second correcting element 14*a*, 14*b* for setting the duration of the counter-pulse. This controls when the changeover of operation from the first activated switching element to the second, not previously activated switching element will occur. Furthermore, the first switching element 3*a* or the second switching element 3*b* is connected to a third correcting element 15*a*, 15*b* for setting the overtravel time. The correcting elements 13*a*, 13*b*; 14*a*, 14*b*; and 15*a*, 15*b* may consist of potentiometers.

Figures 2A, 2B:
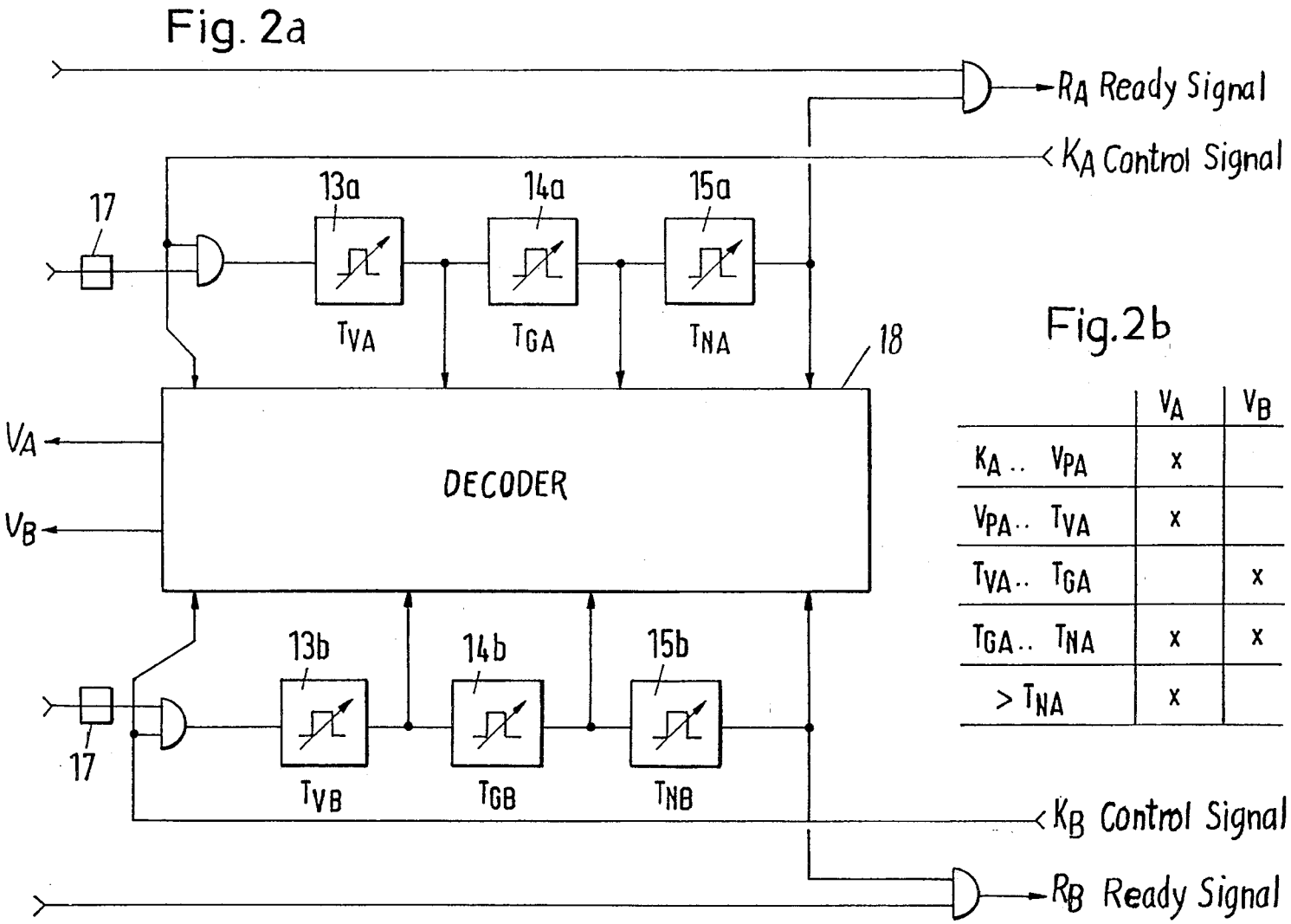
FIG. 2*a* is a block diagram of the counter-pulse module.
FIG. 2*b* is a table of decoder functions for a travel job.

The functionality of the decoder 18 in controlling the changeover in operation or activation of the valves is illustrated in FIG. 2*b*. In the time between receipt by the decoder of the control signal KA and transmission of the control signal to the pre-positioning sensor 8*a* ($V_{PA}$), a signal is sent to $V_A$. In the time, T1, between the receipt of the signal by the pre-positioning sensor 8*a* ($V_{PA}$) and the operation of the first correcting element 13*a*, a signal is again sent to $V_A$ and operation is through valve 4*a*. Changeover in the activation or operation of the first and second switching elements 3*a*, 3*b* occurs at the time, T2, between receipt of the signal $T_{VA}$ and receipt of the signal $T_{GA}$ wherein a signal is sent to $V_B$ indicating a changeover to operation of valve 4*b*. At the time between the operation of the second correcting element 14A and the third correcting element 15*a*, T3, a signal is sent to both $V_A$ and $V_B$, and operation is effected through both valves 4*a* and 4*b*. This is the previously mentioned overtravel condition. At the time after the operation of the third correcting element 15*a*, operation is once again through valve 4*a*.

Figure 3:
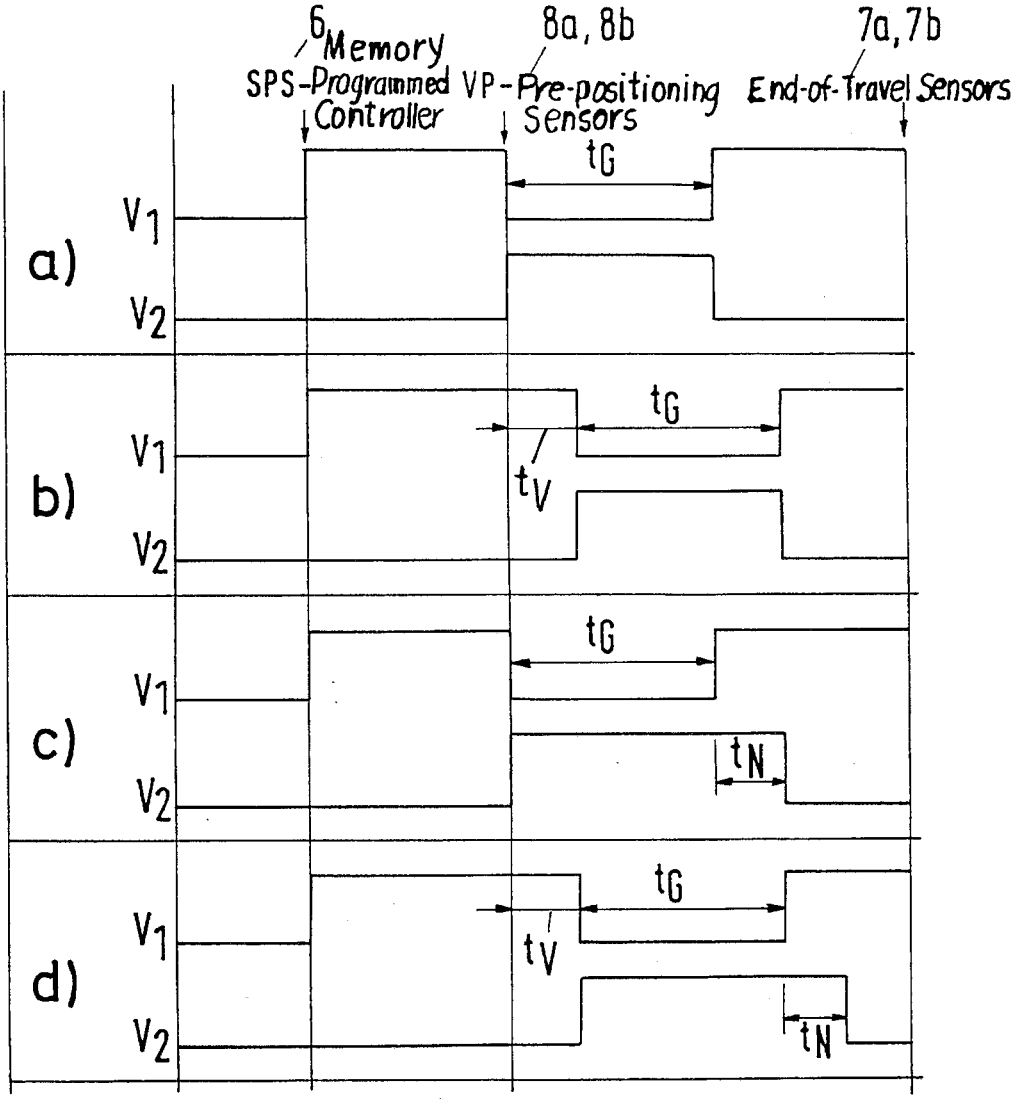
FIG. 3 is a timing chart for various operating states of the two switching elements and valves.

FIG. 3 is a timing diagram for various operating states of the two switching elements 3*a*, 3*b* and valves 4*a*, 4*b*. A counter-pulse at previously mentioned time T2, $t_G$, in which a changeover takes place after recognition of the moving element's pre-position, and after which normal control is again exercised for continued movement of the element to its stop or end-of-travel position, is illustrated by (a) of FIG. 3. A second operating mode, illustrated by (b) of FIG. 3, is a delay with the counter-pulse (T1+T2), ($t_v$+$t_G$), whereby T1 delays the pre-positioning sensor in a settable fashion. An exact mechanical adjustment of the pre-positioning sensor 8*a*, 8*b* can thus be dispensed with. A third operating mode is a counter-pulse with overtravel (T2+ T3), ($t_G$+$t_N$) and is shown in (c) of FIG. 3. Both switching elements 3*a*, 3*b* are activated during a time T3, making possible a non-powered approach of the driving force element to a stop at low speed. In this way, fluctuations in operating load or pressure have less of an effect. A fourth operating mode calls for delay plus counter-pulse plus overtravel (T1+T2+T3), ($t_v$+$t_G$+$t_N$); this mode is illustrated in (d) of FIG. 3. Here, too, exact adjustment of the pre-positioning sensor 8*a*, 8*b* is unnecessary; a non-powered approach of the driving force element to a stop occurs at low speed, making the drive less sensitive to fluctuations in the operating conditions as the result of pressures or the load.

Furthermore, the drive includes a logic circuit which recognizes the "first" start of the drive and adjusts the times based upon the starting conditions, which may and often do differ from those in continuous or steady-state operation.

Figure 4:
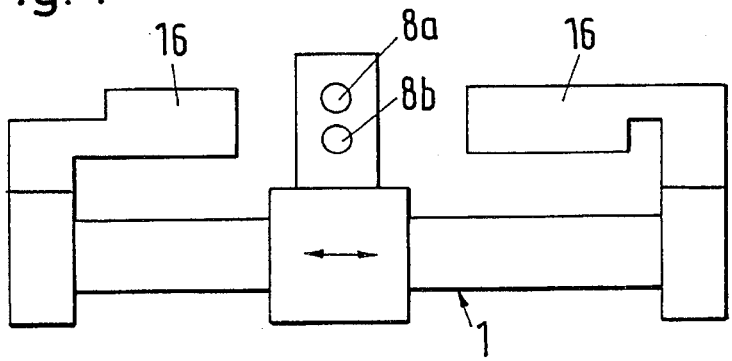
FIG. 4 is a diagrammatic front view of a cylinder without piston rods in a basic configuration.

The end-of-travel sensors 7*a*, 7*b* and the pre-positioning sensors 8*a* and 8*b* may also be configured to incorporate control tabs 16 as shown in FIG. 4. Through coded analyses of the control tabs, two pre-positions and two end of travel positions 1*c*, 1*d* may be recognized.

The first and second switching elements 3*a*, 3*b* may consist of either a hydraulic or pneumatic form of a control valve 4, which is controlled by both the counter-pulse 5 and the memory-programmable controller 6.

The connections for the end-of-travel sensors 7*a*, 7*b* and for the pre-positioning sensors 8*a*, 8*b*, as well as for the first and second switching elements 3*a*, 3*b*, may also be advantageously connected using optocouplers 17.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the invention, therefore, to be limited only as indicated by the scope of the claims appended hereto.

I claim:

1. A drive for controlling an element transmitting a driving force to an element moveable between two end-of-travel positions, comprising:

means for controlling the driving force element to damp the moveable element proximate at least one of the end-of-travel positions;

first and second pre-positioning sensors disposed proximate the end-of-travel positions of the moveable element; and first and second switching elements each coupled to a respective one of said first and second pre-positioning sensors, wherein said controlling means includes a counter-pulse module coupled to the pre-positioning sensors and operable for causing, in response to a signal from one of the first and second pre-positioning sensors associated with at least one movement direction during operation of said first switching element, a chronologically setable changeover from said first switching element associated with a first of said end-of-travel positions to said second switching element associated with a second of said end-of-travel positions to cause and damp movement of the moveable element by operation of the first and then the second switching elements.

2. The drive as claimed in claim 1, wherein the counter-pulse module is further operable for causing both the first and second switching elements to be simultaneously activated after the changeover of said first and second switching elements to effect an overtravel condition.

3. The drive as claimed in claim 2, wherein the controlling means further comprises a first correcting element for delaying the changeover of the first and second switching elements.

4. The drive as claimed in claim 3, wherein the controlling means further comprises a second correcting element connected to one of the first switching element and the second switching element for setting a duration of a counter-pulse.

5. The drive as claimed in claim 4, wherein the controlling means further comprises a third correcting element connected to one of the first switching element and the second switching element for setting a time of overtravel.

6. The drive as claimed in claim 5, further comprising a logic circuit for recognizing a first start of the drive and for adjusting times based upon starting conditions which differ from conditions of stationary operation.

7. The drive as claimed in claim 6, wherein the control means further includes a plurality of separately settable correcting elements for each direction of travel.

8. The drive as claimed in claim 1, further comprising first and second end-of-travel sensors and first and second control tabs, wherein each of said first and second control tabs are coupled to a respective one of said first and second end-of-travel sensor and a respective one of said first and second pre-positioning sensors to enable recognition of two pre-positions and two ends of travel through a coded evaluation.

9. The drive as claimed in claim 1, wherein the controlling means further comprises a memory-programmable controller, and wherein the first and the second switching elements each comprise a control valve, said control valves being controlled by the counter-pulse module and the memory-programmable controller.

10. The drive as claimed in claim 1, further comprising first and second end-of-travel sensors, wherein the first and second end-of-travel sensors, the first and second pre-positioning sensors and the first and second switching elements are connected by optocouplers.

11. The drive as claimed in claim 1, wherein the driving force element is at least single-acting.

12. The drive as claimed in claim 1, wherein each of the first and second switching elements comprise one of hydraulic and pneumatic control valves.

* * * * *